US011253905B2

(12) United States Patent
Bratsch

(10) Patent No.: US 11,253,905 B2
(45) Date of Patent: Feb. 22, 2022

(54) SPRING-LOADED KNOCKOUT PAD

(71) Applicant: XOLUTION GmbH, Munich (DE)

(72) Inventor: Christian Bratsch, Salzburg (AT)

(73) Assignee: XOLUTION GmbH, Munich (DE)

( * ) Notice: Subject to any disclaimer, the term of this patent is extended or adjusted under 35 U.S.C. 154(b) by 362 days.

(21) Appl. No.: 16/268,049

(22) Filed: Feb. 5, 2019

(65) Prior Publication Data

US 2019/0240718 A1 Aug. 8, 2019

(30) Foreign Application Priority Data

Feb. 6, 2018 (EP) ..... 18155212

(51) Int. Cl.
*B21D 51/26* (2006.01)
*B21D 51/32* (2006.01)

(52) U.S. Cl.
CPC ..... *B21D 51/2661* (2013.01); *B21D 51/2684* (2013.01); *B21D 51/32* (2013.01); *B21D 51/2692* (2013.01)

(58) Field of Classification Search
CPC ..... B21D 51/2661; B21D 51/2692; B21D 51/2684; B21D 51/2653; B21D 51/32; B21D 51/30
USPC ..... 413/27
See application file for complete search history.

(56) References Cited

U.S. PATENT DOCUMENTS 1,517,740 A * 12/1924 Malmquist ..... B21D 51/32 413/40
2,385,429 A * 9/1945 Underwood ..... B67B 3/14 53/351
2,433,057 A * 12/1947 Mero ..... B65B 31/025 53/510
2,502,413 A * 4/1950 Birkland ..... B21D 51/32 413/32
2,540,611 A * 2/1951 Fawcett ..... B21D 51/32 413/40
2,885,851 A * 5/1959 Aldington ..... B65B 7/285 53/357
5,299,899 A * 4/1994 Katou ..... B21D 51/32 413/27
5,320,469 A * 6/1994 Katou ..... B21D 51/32 413/27
5,358,369 A * 10/1994 Katou ..... B21D 51/26 413/27
5,533,853 A * 7/1996 Wu ..... B21D 51/2653 413/31
6,055,836 A * 5/2000 Waterworth ..... B21D 19/046 72/110
2002/0081172 A1* 6/2002 Wu ..... B65B 7/285 413/27

(Continued)

FOREIGN PATENT DOCUMENTS

JP 62234628 A 10/1987

*Primary Examiner* — Gregory D Swiatocha
(74) *Attorney, Agent, or Firm* — Dykema Gossett PLLC

(57) ABSTRACT

Various embodiments of the present disclosure are directed to seaming assembly for seaming a can lid onto a can body. In one example embodiment, a seaming assembly includes a chuck; and a knockout pad that is movable relative to said chuck in an axial direction of said chuck. The knockout pad includes a fastening element, and a holding element in a spring-loaded manner relative to the fastening element such that contact with the can lid is effected and established in a spring-loaded region.

12 Claims, 5 Drawing Sheets

(56) References Cited

U.S. PATENT DOCUMENTS

2011/0033265 A1* 2/2011 Gogola ..... B21D 51/32
413/31
2014/0321949 A1* 10/2014 Mejia-Quinchia .....
B21D 51/2653
413/4

* cited by examiner

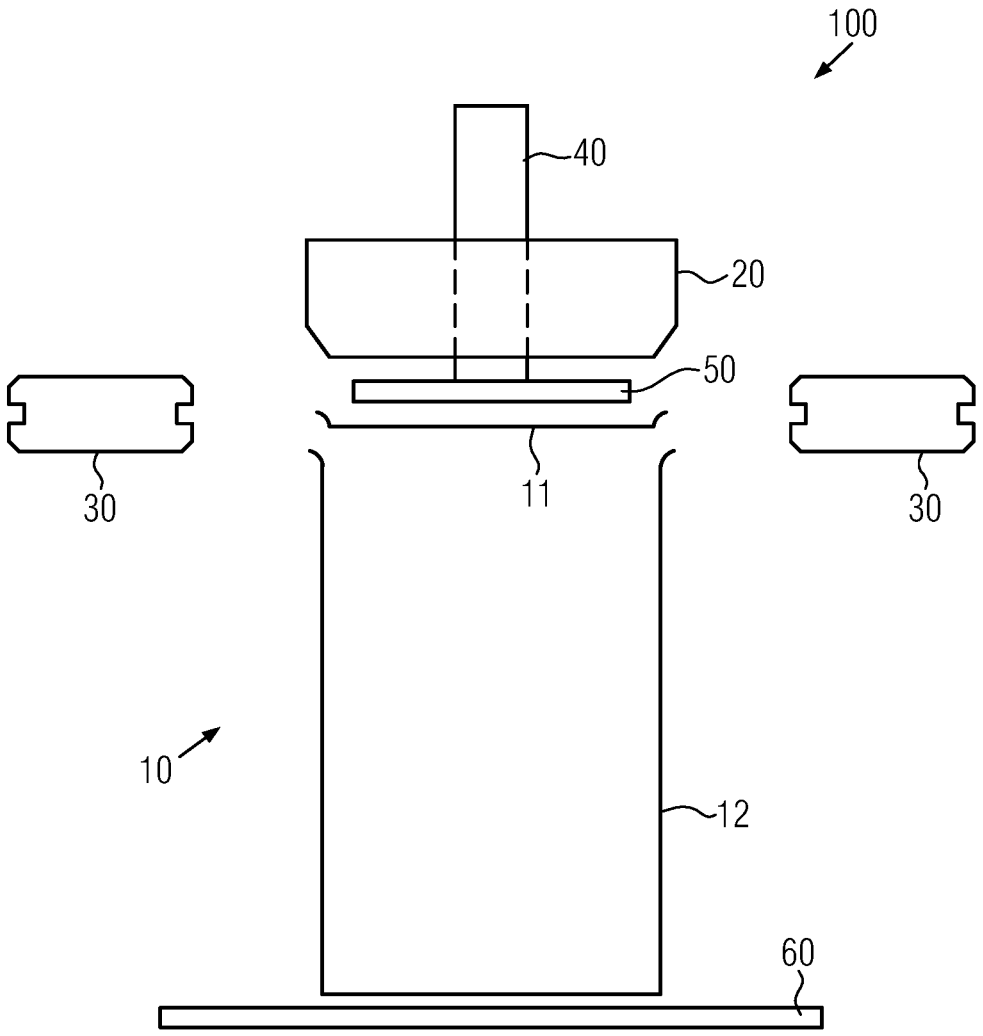
FIG. 1A [PRIOR ART]

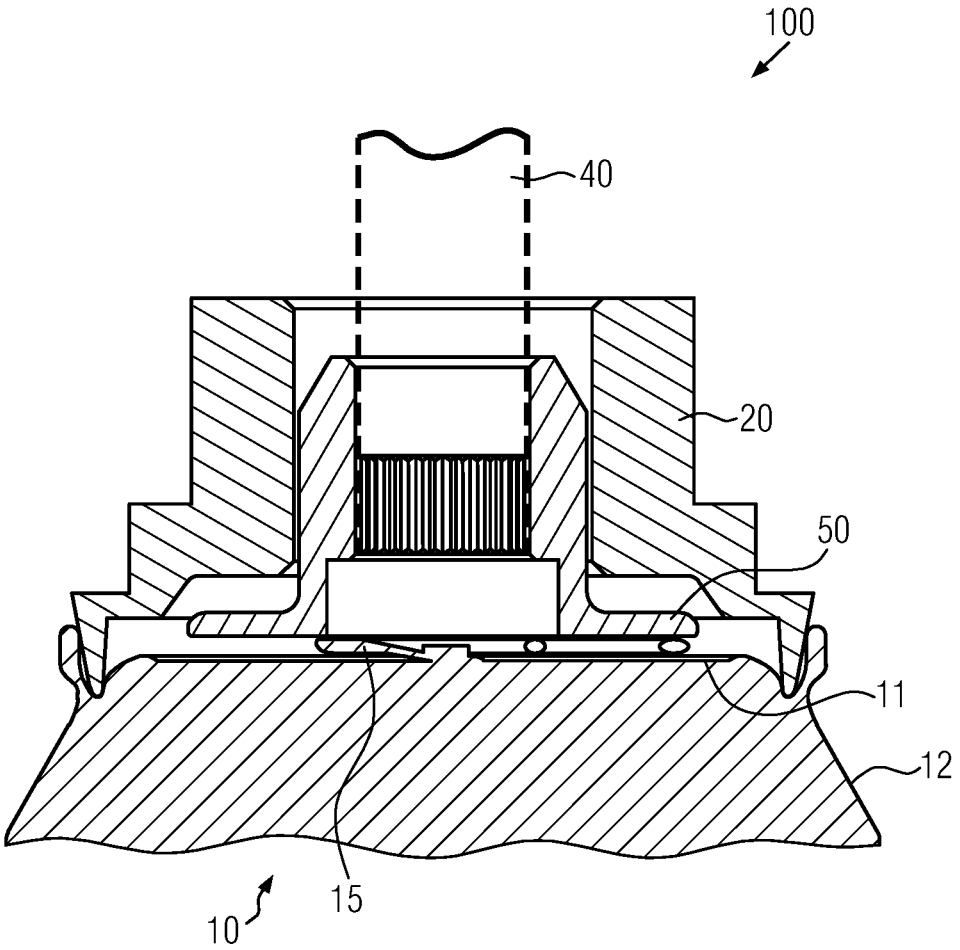
FIG. 1B [PRIOR ART]

SPRING-LOADED KNOCKOUT PAD

CROSS-REFERENCE TO RELATED APPLICATION

This application claims the benefit of priority to European patent application No. 18155212.6, filed 6 Feb. 2018, which is incorporated herein by reference in its entirety as though fully set forth herein.

TECHNICAL FIELD

The present invention relates to a seaming assembly for seaming a can lid onto a can body.

BACKGROUND

For the reason that the nomenclature in the field of can closure from the English language is often also used in the German language, the respective corresponding English terms are also given in parentheses in the following or are used synonymously in the text.

When filling beverage cans, the cans pass through a can capper in the form of a seamer after having been filled, where the filled can bodies enter via one infeed path and can lids enter via a further infeed path. The seamer usually comprises several similar stations arranged in the form of a carousel, so-called seaming stations (also referred to below as seaming assembly), in each of which a can is closed with a lid. The lids are guided onto the cans and held thereon by a knockout pad of a seaming chuck. This knockout pad is designed such that a holding element (for example a plate) is formed in the region which comes into contact with the can lid. This holding also serves to secure the cans against breaking out from the circular path followed by the cans in the capper due to the centrifugal force. In the capper, the cans and the lid are seamed at the edge by way of capping rollers and thus closed. The can with the lid generally additionally rotates about its own axis of symmetry.

The knockout pads are disposed inside the chuck and are vertically movable relative to the chuck. When seaming a can lid onto a can body (also referred to as curling a lid onto a can body), the cans in the carousel-like machine region run around an axis of rotation. The assemblies made of the chuck (including the knockout pad) and two respective closing rollers are arranged at the circumference. Between four and twelve assemblies are typically arranged depending on the configuration of the capper. When the carousel revolves, the lid is placed on the can body, the filled can body with the lid is raised against the chuck, the curling is performed successively by the first and the second closing roller. At the end of the cycle, the filled can is lowered again and removed from the chuck. Depending on the operating speed, relatively high centrifugal forces arise which can hurl the can outwardly and possibly lead to interruptions in operation. To avoid this, the aforementioned knockout pads, which co-perform the lowering motion of the filled can, are used and during the lowering motion counteract the centrifugal forces with constant light pressure, for example, onto the central portion of the can lid. For smooth operation, however, a very accurate design and adjustment of the knockout pads is required.

The force exerted is there defined by a predetermined and preset stroke of the knockout pad (in interaction with the resilient properties of the lid and the can), which can lead to damage already when the can or the lid dimensions deviate slightly from the dimensions underlying the adjustment of the stroke, for example, if the pressure is too great, or disruptions of the closing device can arise due to poor localization of the can when the pressure is too low. If the stroke of the holding plate pressing onto the lid from above is too short, the can can be fixed into position only insufficiently. If the stroke is too long, the lid is bent, which is also undesirable. With certain types of lids, the opening devices arranged in the lid for opening the can can even be destroyed.

With larger deviations from a preset type of can due to different types of cans or lids to be seamed, a time-consuming conversion and/or adjustment work for adjusting the stroke of the knockout pads is necessary. As a result of product innovation, many different configurations of the can lids have meanwhile arisen, in particular with regard to the height level of the contact points or contact surfaces of the lid where the knockout pad engages.

BRIEF SUMMARY

The object of the invention is to overcome—at least in part—the disadvantages mentioned. This object is satisfied with a seaming assembly for seaming a can lid onto a can body.

The seaming assembly according to the invention for seaming a can lid onto a can body comprises a chuck and a knockout pad that is movable relative to the chuck in an axial direction of the chuck, where the knockout pad comprises a holding element arranged in a spring-loaded manner.

The seaming assembly according to the invention has the advantage over prior art that a force exerted upon the can lid is determined by the spring load of the assembly (and the force exerted is not determined by the predefined stroke like in prior art). Contact with the can lid is effected in the spring-loaded region (i.e., not up to the end of the spring travel with a hard stop), so that the force exerted upon the lid is defined by the spring action, for example, by the spring constant of a spring and by the resting position/pre-tension defined by the preset stroke when contacting.

The seaming assembly according to the invention can therefore be further developed in that the holding element is provided for exerting force upon a can lid that is determined by a spring load of the spring-loaded assembly. The stroke of the knockout pad is preferably preset such that the holding element contacts the can lid with the available spring travel being in a central region. Accordingly, the spring load exerted is in a central region of the available spring load range. An adjustment or yield margin is therefore present in both directions from the center position, i.e. "soft" exertion of force in contrast to the "hard" exertion of force according to prior art.

The knockout pad can be disposed on a knockout rod, and the knockout rod can be movable together with the knockout pad in the axial direction relative to the chuck. This provides a simple way to move the spring-loaded holding element relative to the chuck.

The seaming assembly according to the invention can be further developed in that the knockout pad further comprises a fastening element, where the fastening element is attached to the knockout rod. In this way, the knockout pad can be firmly connected to the knockout rod.

The former can in turn be further developed in that the holding element is mounted in a spring-loaded manner relative to the fastening element. The spring-loaded assembly of the holding element according to the invention is therefore realized between the fastening element that is fixedly connected to the knockout rod and the holding element.

According to a further embodiment, the holding element can be arranged rotatable about an axis of rotation extending in the axial direction relative to the fastening element. In this manner, a rotation necessary for the closing motion can be performed relative to the fastening element or the knockout rod. According to prior art, such a rotation is caused only by rotation of the knockout rod together with the knockout pad.

Furthermore, a lifting element can be provided, where the can body with the can lid is arranged between the lifting element and the chuck during a seaming operation. The can body can be raised (possibly together with the can lid) by the lifting element and pressed against the chuck.

The spring load of the spring-loaded assembly can be exerted by the holding element of the knockout pad from above upon the can lid during the seaming operation in order to locate the latter on the can body.

According to a further development, the knockout pad and/or the knockout rod can be moved synchronously with the lifting element during a knockout operation, where the spring load of the spring-loaded assembly can be exerted upon the can lid from above by the holding element of the knockout pad and an equal counterforce can be exerted upon the can body from below by the lifting element. In this way, the can body can be moved with the can lid on a defined path towards the chuck and/or moved away from the chuck after seaming.

Another development is that at least one spring, in particular at least one coil spring, is provided between the holding element and the knockout rod or between the holding element and the fastening element. One or more springs (coil springs) can provide the spring-loaded assembly. For example, a coil spring contacting the fastening element at one end and the holding element in a respective circumferential region at an end opposite thereto can be used. Alternatively or additionally, an elastomer spring (for example, in the form of a rubber ring) or a leg spring can be provided for providing the spring-loaded assembly of the holding element.

According to another embodiment, the spring load of the spring-loaded assembly of the holding element is between 10 and 50 N and/or a spring travel of the holding element arranged in a spring-loaded manner is between 0.2 and 2.0 mm. These are preferred values, which, firstly, provide secure holding of the can lid or the seamed can, respectively, and, secondly, avoid damage to the lid or the can.

Another development is that the seaming assembly further comprises at least one seaming roller, in particular two seaming rollers.

The invention further provides a seamer comprising the following: a carousel having a plurality of seaming assemblies according to the invention or according to one of the further developments; a first inlet for can bodies, in particular can bodies filled with a product, to the carousel; a second inlet for can lids to the carousel; and an outlet for seamed cans from the carousel.

The object mentioned above is further satisfied with a method for seaming a can lid onto a can body.

The method according to the invention for seaming a can lid onto a can body comprises the steps of: supplying the can lid and the can body to a seaming assembly of a seamer; positioning the can lid on the can body; positioning the can body on a lifting element; exerting a spring load upon the can lid by way of a spring-loaded holding element of a knockout pad that is movable relative to a chuck in an axial direction of the chuck; seaming the can lid to the can body by way of at least one seaming roller, in particular using two seaming rollers, and the chuck; synchronously lowering the knockout pad and the lifting element while maintaining the spring load on the can lid; raising the knockout pad from the can lid; and discharging the seamed can from the seamer.

Furthermore, the invention therefore relates to a method for seaming a can lid onto a can body using the seamer according to the invention.

The developments mentioned can be used individually or as claimed in suitable combination with each other.

Further features and exemplary embodiments as well as advantages of the present invention shall be illustrated below using the figures. It is understood that the embodiments do not exhaust the scope of the present invention. It is further understood that some or all features described hereafter can also be combined with each other in different ways.

BRIEF DESCRIPTION OF THE DRAWINGS

FIG. 1A shows a seaming assembly according to prior art.

FIG. 1B shows a seaming assembly according to prior art.

DETAILED DESCRIPTION

Figure 2A:
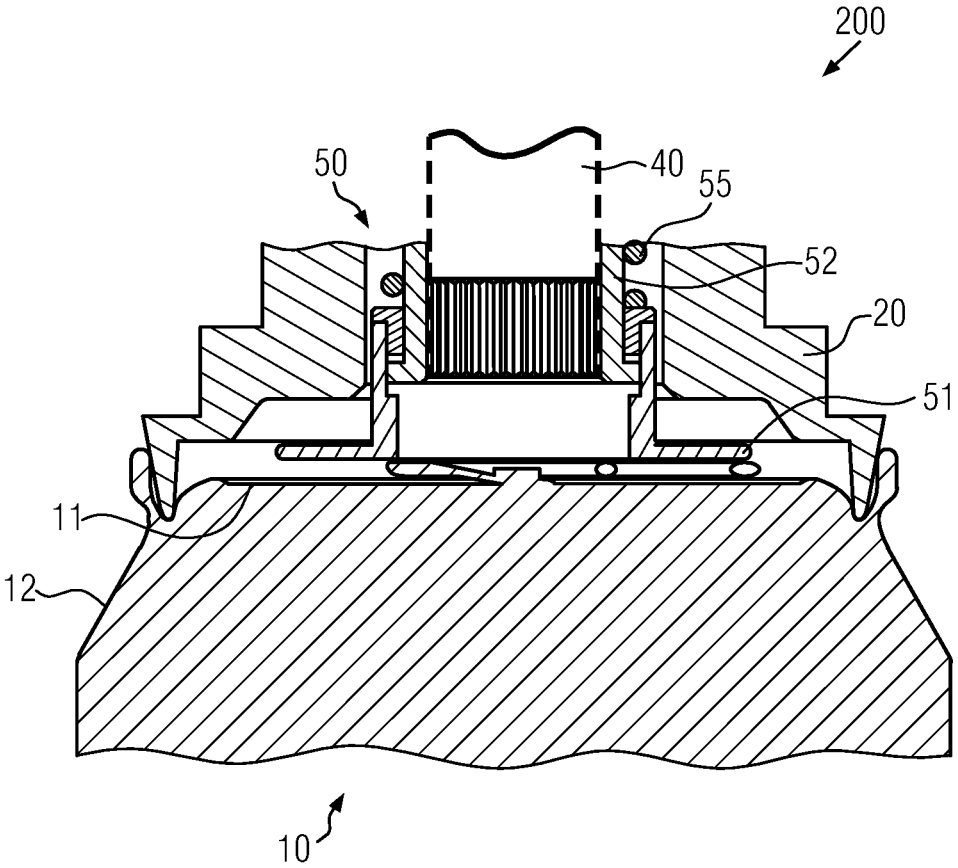
FIG. 2A shows an embodiment of the seaming assembly according to the invention.

FIGS. 1 A and 1B show a seaming assembly 100 according to prior art.

Prior art seaming assembly 100 illustrated is for seaming/curling the edge of a metallic can lid 11 to the upper edge of a metallic can body 12 (in other words, seaming can lid 11 to can body 12) to provide a closed can 10, for example, a beverage can. Seaming assembly 100 comprises a chuck 20 and a knockout pad 50 that is movable relative to chuck 20 in an axial direction of chuck 20. Knockout pad 50 is secured on a knockout rod 40, and knockout rod 40 can be moved together with knockout pad 50 in the axial direction relative to chuck 20.

Can lid 11 is seamed onto can body 12 by way of the known double seaming method. The double seaming operation is typically executed on a seamer having a plurality of seaming assemblies 100. Each seaming assembly 100 comprises such a (rotatable) chuck 20 which serves as an anvil to support can body 12 while two rotatable seaming rollers 30 perform the seaming operation using a special groove geometry for producing a typical double seam. The ejection of seamed can 10 is achieved by use of knockout pad 50, which acts upon can lid 11 to release can 10 from the engagement with chuck 20. The can is there supported from below by a lifting element 60.

The disadvantage there is that a faulty setting of the stroke of knockout rod 40 with knockout pad 50 can, firstly, damage the lid or, secondly, limit the function of knockout pad 50, which can lead to production disturbances. For example, opening elements 15 on can lid 11, which serve to open the can to be opened by a user, can be damaged. In the case of conventional beverage cans, for example, the rivet, with which the tab for opening is attached, can be damaged. Other types of damage can occur, in particular, with resealable cans, since plastic elements are used in part. In addition, when changing over to different types of lids—as already mentioned above—changeover times can be incurred due to the need to exchange parts or due to the need to change settings.

Figure 2B:
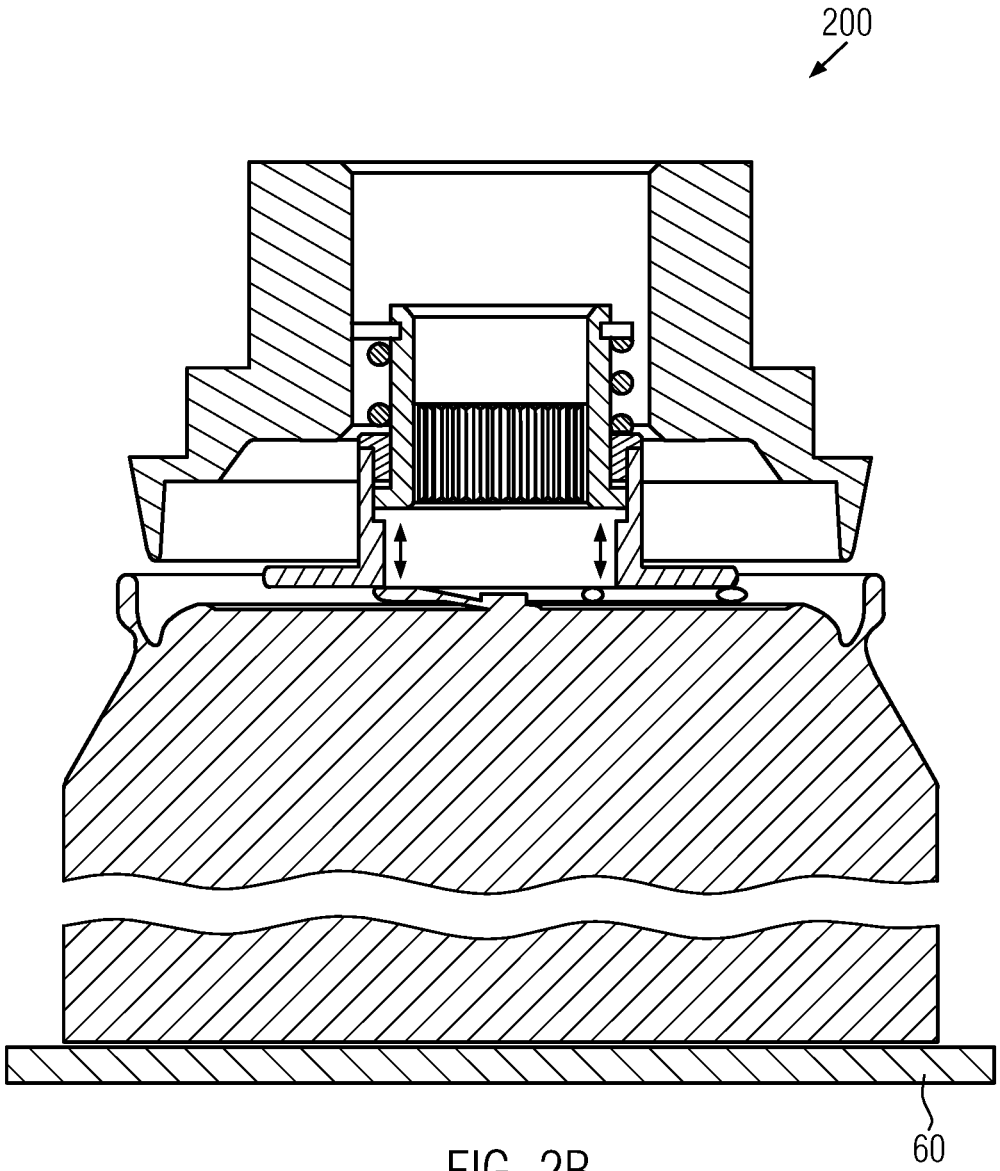
FIG. 2B shows an embodiment of the seaming assembly according to the invention.
Figure 2C:
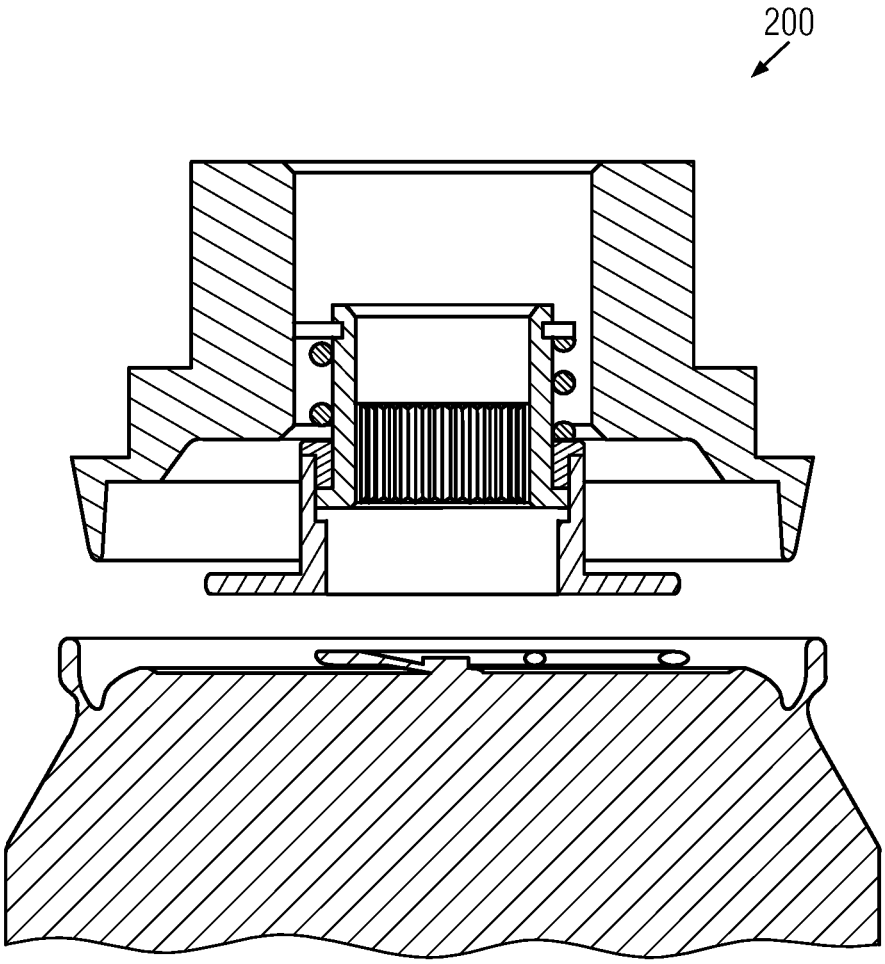
FIG. 2C shows an embodiment of the seaming assembly according to the invention.

FIGS. 2A, 2B and 2C show a seaming assembly 200 according to the invention.

Seaming assembly 200 according to the invention for seaming a can lid 11 onto a can body 12 comprises a chuck 20 and a knockout pad 50 that is movable relative to chuck 20 in an axial direction of chuck 20, where knockout pad 50 comprises a holding element 51 arranged in a spring-loaded manner. Knockout pad 50 is secured on a knockout rod 40, and knockout rod 40 can be moved together with knockout pad 50 in the axial direction relative to chuck 20. Knockout pad 50 further comprises a fastening element 52, where fastening element 52 is attached to knockout rod 40. Holding element 51 is mounted relative to the fastening element in a spring-loaded manner. The spring-loaded assembly of the holding element according to the invention is therefore realized between fastening element 52 fixedly connected to knockout rod 40 and holding element 51.

At least one spring 55 is provided between holding element 51 and fastening element 52 (alternatively between holding element 51 and knockout rod 40). One or more springs (coil springs) can provide the spring-loaded assembly. For example, a coil spring 55 like in this embodiment can be employed, which contacts fastening element 52 at one end and holding element in a respective circumferential region at an end opposite thereto.

The spring load of the spring-loaded assembly of holding element 51 can be between 10 and 50 N. The spring travel of holding element 51 arranged in a spring-loaded manner can be between 0.2 and 2.0 mm. These are preferred values, which, firstly, provide secure holding of can lid 11 or seamed can 10, respectively, and, secondly, avoid damage to lid 11 or can 10.

The contact of holding element 51 to can lid 11 is established in a springy region, so that the force exerted on lid 11 is defined by the spring action, in this embodiment, by the spring constant of a spring 55 and by the resting position/pre-tension defined by the preset stroke when contacting. Holding element 51 is provided for exerting force upon a can lid 11 determined by the spring load of spring 55. The stroke of knockout pad 50 is preset such that holding element 51 contacts can lid 11 in a central region of the available spring travel (see double arrow). Accordingly, the spring load exerted is in a central region of the available spring load range. Therefore, an adjustment or yield margin exists in both directions from the center position.

Furthermore, a lifting element 60 is provided, where can body 12 with can lid 11 is during a seaming operation arranged between lifting element 60 and chuck 20. Can body 12 can be raised using lifting element 60 (possibly together with can lid 11) and pressed against chuck 20. The spring load of the spring-loaded assembly can be exerted by holding element 51 of knockout pad 50 (by spring 55) from above upon can lid 11 during the seaming operation in order to hold can lid 11 on can body 12.

Knockout pad 50 together with knockout rod 40 can be moved synchronously with lifting element 60 during a knockout operation, where the spring load of the spring-loaded assembly can be exerted upon can lid 11 from above by holding element 51 of knockout pad 50 and an equal counterforce can be exerted upon can body 12 from below by lifting element 60. In this way, can body 12 can be moved with can lid 11 on a defined path towards chuck 20 and/or moved away from chuck 20 as a seamed can 10 after seaming (see FIG. 2B). Once seamed can 10 has been taken out of chuck 20 in this manner, can 10 which is clamped between holding element 51 and lifting element 60 is released by raising holding element 51 (by raising knockout rod 40) (see FIG. 2C) in order to then be discharged from seaming assembly 200 and subsequently also from of the seamer.

The embodiments illustrated are only by way of example and the full scope of the present invention is defined by the claims.

The invention claimed is:

1. A seaming assembly for seaming a can lid onto a can body, the seaming assembly comprising:
- a chuck; and
- a knockout pad that is movable relative to said chuck in an axial direction of said chuck, the knockout pad includes:
  - a fastening element, and
  - a holding element configured and arranged in a spring-loaded manner relative to the fastening element, thereby forming a spring-loaded assembly such that contact with said can lid is effected and established in a spring-loaded region,
- at least one spring positioned above said holding element and around said fastening element, and
- a knockout rod, wherein said knockout pad is secured on the knockout rod, and the knockout rod is configured and arranged to be moved together with said knockout pad in the axial direction of said chuck.

2. The seaming assembly according to claim 1, where said holding element is formed to exert a force determined by a spring load of said spring-loaded assembly upon the can lid.

3. The seaming assembly according to claim 2, where the spring load of said spring-loaded assembly is between 10 and 50 N and/or where a spring travel is between 0.2 and 2.0 mm.

4. The seaming assembly according to claim 1, wherein said fastening element is attached to said knockout rod.

5. The seaming assembly according to claim 1, further comprising a lifting element, where the can body with the can lid is arranged between said lifting element and said chuck during a seaming operation.

6. The seaming assembly according to claim 5, where a spring load of said spring-loaded assembly is configured and arranged to be exerted by said holding element of said knockout pad from above upon said can lid during the seaming operation.

7. The seaming assembly according to claim 5, wherein the knockout pad and/or said knockout rod can be moved synchronously with said lifting element during a knockout operation, where a spring load of said spring-loaded assembly can be exerted from above upon said can lid by said holding element of said knockout pad, and an equal counterforce can be exerted from below upon said can body by said lifting element.

8. The seaming assembly according to claim 1, wherein the at least one spring is further positioned around said knockout rod.

9. The seaming of claim 8, wherein the at least one spring is selected from a group consisting of: a coil spring, an elastomer spring, and a leg spring.

10. The seaming assembly according to claim 1, further comprising at least one seaming roller.

11. The seaming assembly of claim 1, further including two seaming rollers.

12. A method for seaming a can lid onto a can body, the method comprising the steps of:

supplying said can lid and said can body to a seaming assembly of a warner;

positioning said can lid on said can body;

positioning said can body on a lifting element;

exerting a spring load upon said can lid by way of a spring-loaded holding element and a fastening element of a knockout pad that is movable relative to a chuck in an axial direction of said chuck, wherein the holding element is configured and arranged in a spring-loaded manner relative to the fastening element such that the contact with the can lid is effected and established in a spring-loaded region, wherein said knockout pad is secured on a knockout rod, and said knockout rod can be moved together with said knockout pad in the axial direction relative to said chuck, and wherein at least one spring is positioned above said holding element and around said fastening element;

seaming said can lid to said can body by way of at least one seaming roller and said chuck;

synchronously lowering said knockout pad and said lifting element while maintaining the spring load upon said can lid;

raising said knockout pad from said can lid; and discharging said seamed can from said seamer.

* * * * *